United States Patent [19]

Lizenby

[11] 4,341,557

[45] Jul. 27, 1982

[54] METHOD OF HOT CONSOLIDATING POWDER WITH A RECYCLABLE CONTAINER MATERIAL

[75] Inventor: James R. Lizenby, Traverse City, Mich.

[73] Assignee: Kelsey-Hayes Company, Romulus, Mich.

[21] Appl. No.: 173,648

[22] Filed: Jul. 30, 1980

Related U.S. Application Data

[63] Continuation-in-part of Ser. No. 73,627, Sep. 10, 1979, abandoned.

[51] Int. Cl.[3] ..... B22F 3/00

[52] U.S. Cl. ..... 75/223; 75/226; 264/111; 264/125

[58] Field of Search ..... 75/200, 226, 223, 211; 264/111, 125

[56] References Cited

U.S. PATENT DOCUMENTS

| | | | |
|---|---|---|---|
| 3,622,313 | 11/1971 | Havel | 75/226 |
| 3,866,303 | 2/1975 | Chehi | 75/223 X |
| 3,907,949 | 9/1975 | Carlson | 264/6 |
| 3,982,937 | 9/1976 | Wentzell | 75/223 X |
| 4,023,966 | 5/1977 | Loersch et al. | 75/226 |
| 4,081,272 | 3/1978 | Adlerborn | 75/226 X |
| 4,094,709 | 6/1978 | Rozmus | 75/226 X |
| 4,142,888 | 3/1979 | Rozmus | 75/223 X |

FOREIGN PATENT DOCUMENTS 989255 1/1962 United Kingdom .

*Primary Examiner*—Brooks H. Hunt

*Attorney, Agent, or Firm*—McGlynn and Milton

[57] ABSTRACT

A method for hot consolidating powder of metallic and nonmetallic composition to form a densified powder article by forming a container of a material which melts at a combination of temperature and time at that temperature which combination would not adversely affect the desired microstructure and physical properties of the densified powder article and applying heat and pressure to the exterior of the container to compact and densify the powder within the cavity at a temperature below the melting point of the container and thereafter melting the container into molten metal to remove the container from the densified powder article while maintaining the temperature of the article below the incipient melting temperature of the article. Thereafter, the material from the melted container may be recycled to form a new container.

13 Claims, 1 Drawing Figure

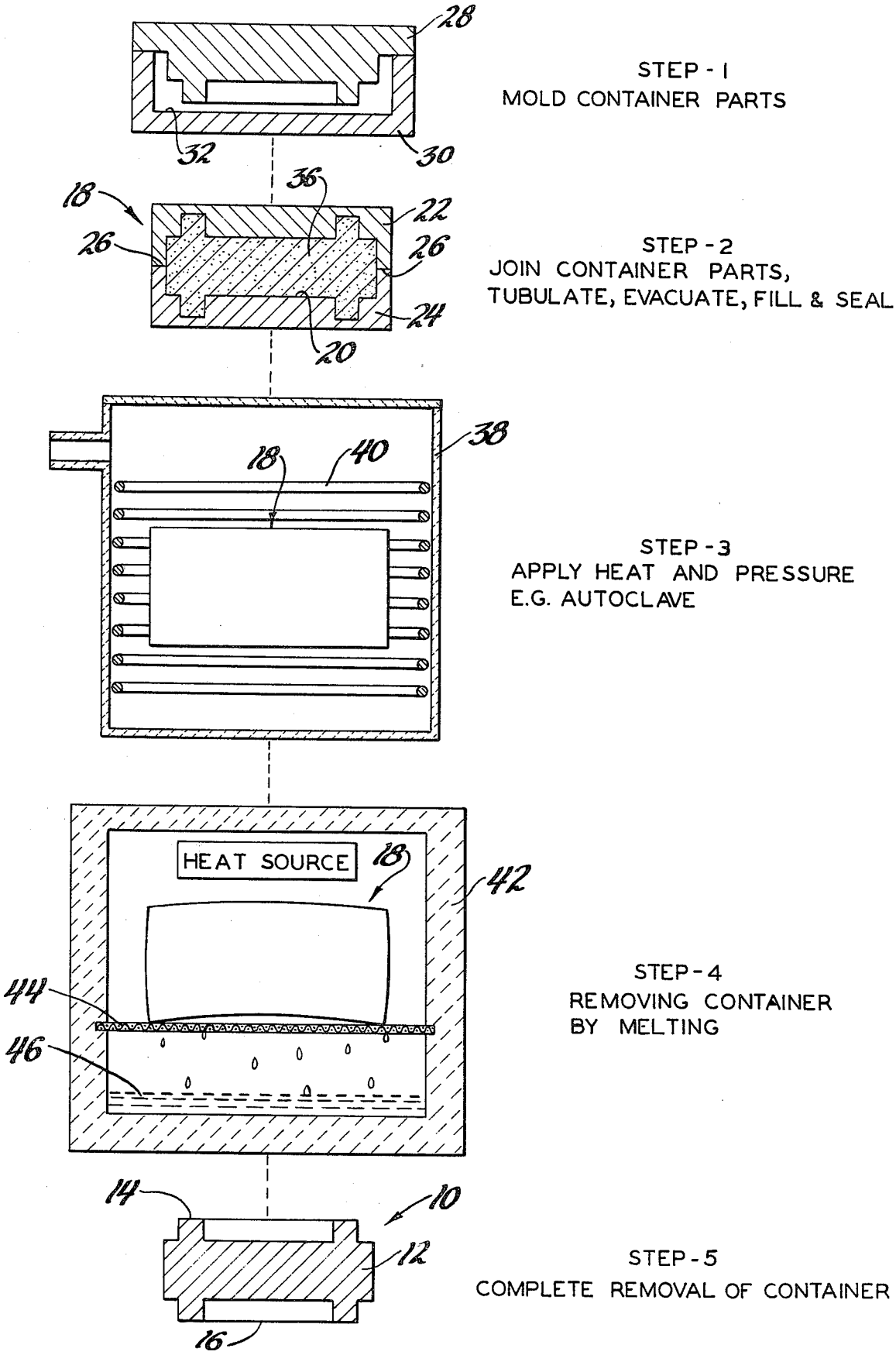
28
32
30
STEP - 1
MOLD CONTAINER PARTS
18
36
22
26
26
24
20
STEP - 2
JOIN CONTAINER PARTS,
TUBULATE, EVACUATE, FILL & SEAL
38
18
40
STEP - 3
APPLY HEAT AND PRESSURE
E.G. AUTOCLAVE
HEAT SOURCE
18
42
44
46
STEP - 4
REMOVING CONTAINER
BY MELTING
14
10
12
16
STEP - 5
COMPLETE REMOVAL OF CONTAINER

METHOD OF HOT CONSOLIDATING POWDER WITH A RECYCLABLE CONTAINER MATERIAL

RELATED APPLICATION

The subject application is a continuation-in-part of the copending application Ser. No. 73,627 filed Sept. 10, 1979, now abandoned.

BACKGROUND OF THE INVENTION (1) Field of the Invention

This invention relates to a method for hot consolidating powder of metallic and nonmetallic composition and combinations thereof.

Hot consolidation of metallic, intermetallic and nonmetallic powders and combinations thereof has become an industry standard. Hot consolidation can be accomplished by filling a container with a powder to be consolidated. The container is usually evacuated prior to filling and then hermetically sealed. Heat and pressure are applied to the filled and sealed container. At elevated temperatures, the container functions as a pressure-transmitting medium to subject the powder to the pressure applied to the container. Simultaneously, the heat causes the powder to fuse by sintering. In short, the combination of heat and pressure causes consolidation of the powder into a substantially fully densified and fused mass in which the individual powder particles change shape as they are forced together and are united into a substantially homogeneous mass.

After consolidation, the container is removed from the densified powder compact or article and the compact is then further processed through one or more steps, such as forging, machining, grinding and/or heat-treating, to form a finished part.

(2) Description of the Prior Art

In the prior art the container is removed from the densified article by machining, leaching or pickling or some combination thereof. As a result, the container material is destroyed and is only used once.

SUMMARY OF THE INVENTION

The subject invention provides a method for hot consolidating powder of metallic and nonmetallic composition and combinations thereof to form a densified article by forming a container having a cavity therein from a material which melts at a combination of temperature and time at that temperature which combination would not adversely affect the desired properties of the densified article and filling the cavity in the container with powder and applying heat and pressure to the container to densify the powder into the densified article and thereafter melting the container into molten material to remove the container from the densified article. Accordingly, the material of the melted container may be recycled to form a new container.

PRIOR ART STATEMENT

The subject invention is best employed with a "fluid die" or "thick-walled" container of the type described in U.S. Pat. No. 4,142,888 granted Mar. 6, 1979 in the name of Walter J. Rozmus. As explained in that patent, a thick-walled container or fluid die is one which was walls entirely surrounding the cavity and of sufficient thickness so that the exterior surface of the walls do not closely follow the contour or shape of the cavity and of a material which is substantially fully dense and incompressible and capable of plastic flow at elevated temperatures of yielding to produce a hydrostatic pressure on the powder within the cavity upon the application of heat and pressure to densify the powder. That patent, however, teaches that, after the consolidation of the powder article, the container is removed by machining, pickling, or the like. Further, U.S. Pat. No. 3,907,949 granted Sept. 23, 1977 to William G. Carlson teaches the compaction of a powder by isostatic pressing of the powder in a urethane mold carrying therewithin a low melting point metal mandrel. This mandrel is removed after pressing by melting. Thereafter, the powder pressed body is then sintered at a high temperature. The subject invention is, however, novel, in that the container completely surrounds the powder article which is subjected to heat and pressure so as to be consolidated and sintered or densified and remains within the container as the container is melted at a temperature below that which would undesirably or adversely affect or dilute the microstructure and physical properties of the consolidated or densified powder article to remove the container from the article.

BRIEF DESCRIPTION OF THE DRAWING

Other advantages of the present invention will be readily appreciated as the same becomes better understood by reference to the following detailed description when considered in connection with the accompanying drawing which is a flow diagram illustrating the major steps involved in the method of the subject invention.

DESCRIPTION OF THE INVENTION

It will be appreciated that the subject invention may be utilized for hot consolidating various metallic powders and nonmetallic powders as well as combinations thereof to form a densified powder article. As alluded to above, the invention in its preferred form consolidates metallic powder into complex shapes by utilizing a thick-walled container as described above and in the above-mentioned U.S. Pat. No. 4,142,888, the disclosure of which is hereby incorporated by reference. By way of definition, a thick-walled container is of sufficient thickness so that the exterior surface of the walls do not closely follow the contour or shape of the cavity. This insures that sufficient container material is provided so that, upon the application of heat and pressure, the container material will act like a fluid to apply hydrostatic pressure to the powder in the cavity. The use of a thick-walled container produces a near net shape having close dimensional tolerances with a minimum of distortion. Powder articles of near net shapes are precision articles or compacts requiring minimum finish machining or simple operations to produce a final shape.

The drawing illustrates the steps of the method for hot consolidating powder of metallic and nonmetallic composition and combinations thereof to form a densified powder compact or article of near net shape, as generally shown at 10 in Step 5 of the flow diagram. The densified powder compact or article 10 includes a disc shape body 12 having annular rings 14 and 16 extending from opposite sides of the body 12. The specific configuration of the powder article 10 is shown only by way of example and it is to be understood that other shapes may be produced in accordance with the subject invention.

A thick-walled container is generally indicated at 18 and has a cavity 20 therein for receiving powder to be consolidated to form the densified powder compact or article 10. The container 18 is preferably formed by forming at least two mating container parts 22 and 24 which, as illustrated, are identical. The container parts 22 and 24 define the cavity 20 when mated together at mating surfaces 26.

The container parts 22 and 24 are formed in a mold assembly comprising the mold parts 28 and 30 defining the cavity 32. In other words, each container part 22 and 24 is formed within the mold cavity 32, as illustrated in Step 1. The container parts 22 and 24 are formed in the mold cavity 32 from a material which melts at a combination of temperature and time at that temperature which combination would not undesirably or adversely affect the properties of the powder article 10, i.e., after having been consolidated to define the densified powder compact or article 10. The mold parts 28 and 30 are, for example, of a cast iron, and the container is cast from a metal such as copper. The container parts 22 and 24 can, for example, be low pressure die cast. In other words, the molten copper is poured under pressure into the cavity 32 and allowed to solidify. When the container parts 22 and 24 are mated, as shown in Step 2, to define the container 18 the container 18 entirely surrounds the cavity 20 and is of sufficient thickness so that the exterior surface of the walls of the container 18 do not closely follow the contour of the cavity 20. The material, of which the container 18 is made, is substantially fully dense and incompressible and capable of plastic flow at elevated temperatures and/or pressures. Further, the material of which the container 18 is formed will melt at a combination of temperature and time at that temperature which combination would not adversely dilute the desired microstructure and physical properties of the densified powder article 10 so that the article meets predetermined specifications. As will be appreciated, the compacted articles will be made of various different combinations of materials and of various different sizes and shapes for various specified end uses. These various different articles must meet different predetermined specifications to be acceptable for their intended uses. Thus, the container must be melted from the compact in a manner that does not cause the article to fail to meet the predetermined specifications for its intended use.

The combination of temperature and time in melting the container is important because the container may be subjected to a melting temperature below that which would adversely affect the properties of the densified powder compact or article for a very long period of time, i.e., the combination of a relatively low temperature and a relatively long time. Conversely, the container may be subjected to a melting temperature above that which would adversely affect the properties of the densified compact or article but for a short enough period of time that the heat would be taken up in the melting and the densified powder compact or article would not itself reach a temperature level which would adversely affect its properties, i.e., the combination of a relatively high temperature for a relatively short period of time. Thus, it is the combination which is important because the combination of temperature and time must be such that, as the container is being melted, the densified powder compact or article does not reach a temperature which would undesirably or adversely affect the properties of the densified powder compact or article. Said another way, the powder is compacted by heat and pressure to obtain the desired physical properties, e.g., microstructure and physical properties, and the container is melted into molten material from about the article while maintaining the temperature of the article below the incipient melting temperature of the article. The incipient melting temperature will, of course, vary from article to article depending upon the composition of the article. For example, the article may be an alloy of different metals with the grains of the alloy having boundaries wherein the boundaries would begin to melt at a temperature lower than would melt the grains. In such a case the incipient melting temperature would be the lowest temperature at which the boundaries begin to melt. Thus, the incipient melting temperature would be that temperature at which any component, part or phase of a compacted article would begin to melt. Clearly, the incipient melting temperature for a given compacted article will depend upon the ingredients, i.e., the powder material making up that article.

The container parts 22 and 24 may be welded together or they may include flanges (not shown) which are pressed, i.e., cold welded, together to fuse the two parts together.

When the container parts 20 and 24 are mated together as by welding, care is taken to produce a hermetic seal between the container parts 22 and 24 so that the container may be evacuated to produce a vacuum in the cavity 20. Normally, the container 18 will be tubulated as by drilling a hole in one of the container parts for positioning an external fill tube or creating an internal fill tube (neither shown) which communicates with the cavity 20. The container 18 may be filled with powder through the external fill tube which is thereafter hermetically sealed by crimping, welding, or other means. Thus, the container is sealed to completely surround the cavity 20.

Once the cavity 20 of the container 18 is filled with powder 36 and the container 18 has been completely sealed, consolidation of the powder 36 may take place. Consolidation is a densification of the powder 36 and is accomplished by applying heat and pressure to the container 18 to densify the powder 36 into the powder article 10. Heat and pressure may be applied simultaneously by using an autoclave or by preheating and using a forging press as disclosed in the above-mentioned U.S. Pat. No. 4,142,888. Step 3 of the flow diagram is a schematic of an autoclave which includes a pressure vessel 38 having therein the heating coils 40. An isostatic pressure is applied to the exterior surface of the container 18 by the pressure medium, usually an inert gas such as argon. Heat and pressure are applied to the entire exterior surface of the container 18 with the temperature being maintained below the melting temperature of the material defining the container 18 and the pressure being of sufficient magnitude to cause plastic flow of the container 18 walls to subject the powder to a hydrostatic pressure causing the powder to densify. The material of which the container 18 is formed experiences or has a plastic flow at the temperature and pressure required to densify the powder, i.e., the container 18 will experience plastic flow to reduce the volume of the cavity 20 therein. In other words, the application of heat and pressure to the container 18, as illustrated in Step 3, causes the container material 18 to act like a fluid thereby applying a hydrostatic pressure to the heated powder metal 36 contained within the cavity 20. Since the powder 36 contained within the cavity 20 is not at full density, the size of the cavity 20 will decrease to densify the powder 36 into the densified or sintered article 10. Again, the heat and pressure applied to the container 18 compacts the powder into the densified article while maintaining the container below its melting point.

As illustrated in Step 4, after the container 18 is removed from the autoclave, it is placed within a crucible 42 having a grate 44 extending thereacross. An appropriate heat source within the crucible 42 subjects the container 18 to a temperature sufficient to melt the container 18 into molten metal 46. As explained above, the combination of temperature and time at that temperature for melting the temperature is such so as to maintain the temperature of the article below the temperature which would adversely affect the microstructure or physical properties of the densified article 10 resulting from the compaction. The material defining the container 18 will completely melt to expose the densified article 10, although there may be some small traces of container material of the densified article 10 which may be easily removed by simple pickling or leaching.

The molten material or metal 46 may be used to form a new container by being cast in accordance with Step 1. Thus, the material defining the container 18 may be continually recycled.

Various known methods of melting the container may be utilized, however, the melting to accomplish container removal has been performed in a molten bath of the container material to facilitate rapid container melt off.

As illustrated, the container parts 22 and 24 are cast to define a cavity 32; however, it will be appreciated that the cavity may be formed in the container parts by many different processes and combinations thereof. For example, the cavity may be entirely cast, cast and finished by machining, or the like, hot or cold forged, or totally machined into the container parts by various well-known machining techniques.

The subject invention has been practiced by utilizing copper and copper alloys which melts at a temperature of approximately 1985° F. to define the container 18. The powder densified was astroloy and the container 18 was subjected to a pressure of approximately 15,000 psi in the autoclave and at a temperature of approximately 1875° F. for 30 minutes. The container was then subjected to a temperature of 2050° F. for melting the copper to expose the densified powder article. It will be appreciated that the time any given container is subjected to a melting temperature will depend upon the size or mass of the container. A greater mass will require more thermal energy for complete melting from the exterior to the interior thereof than will a smaller mass. Consequently, a smaller mass will require less time at a given temperature for melting.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

I claim:

1. A method for hot consolidating powder of metallic and nonmetallic composition and combinations thereof by heat and pressure to form a densified article comprising the steps of; forming a container having walls entirely surrounding a cavity therein from a material which is substantially fully dense and incompressible and which melts at a combination of temperature and time at that temperature which combination would not adversely affect the desired properties of the densified article, filling the cavity in the container with powder, applying heat and pressure to the container to densify the powder into the densified article, and melting the container into molten material to remove the container from the densified article.

2. A method as set forth in claim 1 including the step of forming a new container from the material resulting from melting the container to expose the powder article.

3. A method as set forth in claim 1 further defined as forming the container from material having a plastic flow at the temperature and pressure required to densify the powder.

4. A method as set forth in claim 1 further defined as forming the container from copper or copper alloy.

5. A method for hot consolidating powder of metallic and nonmetallic composition and combinations thereof by heat and pressure to form a densified article comprising the steps of; casting a thick-walled container having a cavity therein with the walls of the container entirely surrounding the cavity and of sufficient thickness so that the exterior surface of the walls do not closely follow the contour of the cavity and of a material substantially fully dense and incompressible and capable of plastic flow at a temperature below that to which the powder article is subjected for consolidation and which melts at a combination of temperature and time at that temperature which combination would not adversely change the desired physical properties of the densified article so that the article meets predetermined specifications, filling the cavity with powder, applying heat to the entire exterior surface of the container with the temperature being below the melting temperature of the container while applying pressure of sufficient magnitude to cause plastic flow of the container walls to subject the powder to a hydrostatic pressure causing the powder to densify, and melting the container with the densified article therein into molten material from about the article.

6. A method as set forth in claim 5 further defined as forming the container of copper or a copper alloy.

7. A method as set forth in claim 5 including recycling the material from the melted container to cast a new container.

8. A method for hot consolidating powder of metallic and nonmetallic composition and combinations thereof to form a densified article comprising the steps of; filling a cavity with powder in a container which is substantially fully dense and incompressible, sealing the container so that the container completely surrounds the cavity, applying heat and pressure to the container to compact the powder into the densified article while maintaining the container below its melting point, and thereafter raising the temperature of the container to its melting point to melt the container into molten material from about the article.

9. A method for hot consolidating powder of metallic and nonmetallic composition and combinations thereof to form a densified article comprising the steps of; surrounding a cavity filled with powder with a container which is substantially fully dense and incompressible and of a material capable of fluid flow at elevated temperatures to transmit hydrostatic fluid pressure to the material to cause full densification of the powder by the container, heating the container to a compaction temperature below its melting temperature but high enough to allow incompressible fluid flow of the container and high enough to fully densify the powder, applying pressure to the container at the compaction temperature to cause the fluid flow of the container to subject the powder to a pressure sufficient to cause the powder to fully densify, and thereafter heating the container with the fully densified article therein to a melting temperature which is above the compaction temperature to remove the container from the fully densified article.

10. A method as set forth in claim 9 further defined as limiting the time the container is subjected to the melting temperature to prevent a change in the microstructure of the densified article.

11. A method as set forth in claim 9 further defined as limiting the time the container is subjected to the melting temperature to prevent a change in the desired physical properties of the densified article.

12. A method as set forth in claim 9 including the step of forming a new container from the material resulting from melting the container and repeating the steps therewith to densify another article from powder.

13. A method for hot consolidating powder of metallic and nonmetallic composition and combinations thereof by heat and pressure to form a fully densified article comprising the steps of; forming a container having walls entirely surrounding a cavity therein from a material which is substantially fully dense and incompressible and which melts at a combination of temperature and time at that temperature which combination would not adversely affect the desired properties of the fully densified article, filling the cavity in the container with powder, applying heat and pressure to the container to raise the temperature thereof to a compaction temperature to densify the powder into the fully densified article, and melting the container at a melting temperature above the compaction temperature to remove the container from the fully densified article.

* * * * *